United States Patent [19]

Cooper

[11] Patent Number: 4,586,446

[45] Date of Patent: May 6, 1986

[54] APPARATUS AND METHOD FOR ELIMINATING STOP MARKS IN CARPETS ON TUFTING MACHINES

[75] Inventor: James J. Cooper, Ellijay, Ga.

[73] Assignee: Collins & Aikman Corporation, New York, N.Y.

[21] Appl. No.: 775,497

[22] Filed: Sep. 12, 1985

[51] Int. Cl.[4] ..... D05C 15/00

[52] U.S. Cl. ..... 112/79 R

[58] Field of Search ..... 112/79 R, 79 FF, 79 A, 112/274, 275

[56] References Cited

U.S. PATENT DOCUMENTS 2,840,019 6/1958 Beasley .
2,857,867 10/1958 Beasley .
3,529,560 9/1970 Jackson .
3,548,766 12/1970 Colbert .
3,762,346 10/1973 Cobble .
4,151,805 5/1979 Long et al. .

*Primary Examiner*—Ronald Feldbaum
*Attorney, Agent, or Firm*—Bell, Seltzer, Park & Gibson

[57] ABSTRACT

Apparatus and method for operating a tufting machine to prevent the formation of stop marks in the tufted fabric being made wherein upon stoppage of the tufting machine a positive overfeed of an incremental length of all of the tufting yarns occurs in a direction toward the tufting needles for immediately releasing high build up of tension in the tufting yarns and prevent robbing of the height of the last formed row of tufts. Apparatus in the form of a cooperating pair of slip clutches are provided in conjunction with an auxiliary drive apparatus which auxiliary drive apparatus is actuated in response to the stoppage of the machine for immediately providing a positive feed of the tufting yarns.

10 Claims, 3 Drawing Figures

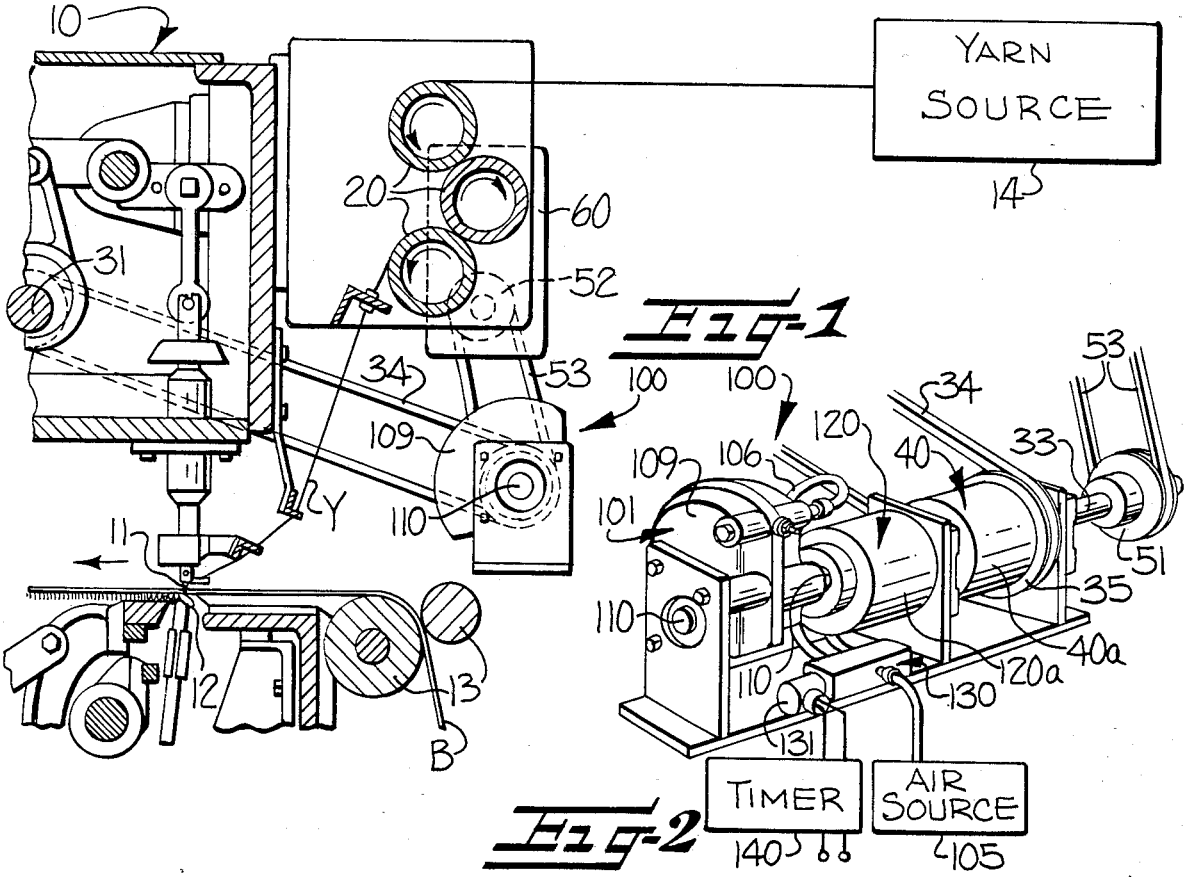
Fig-1
Fig-2
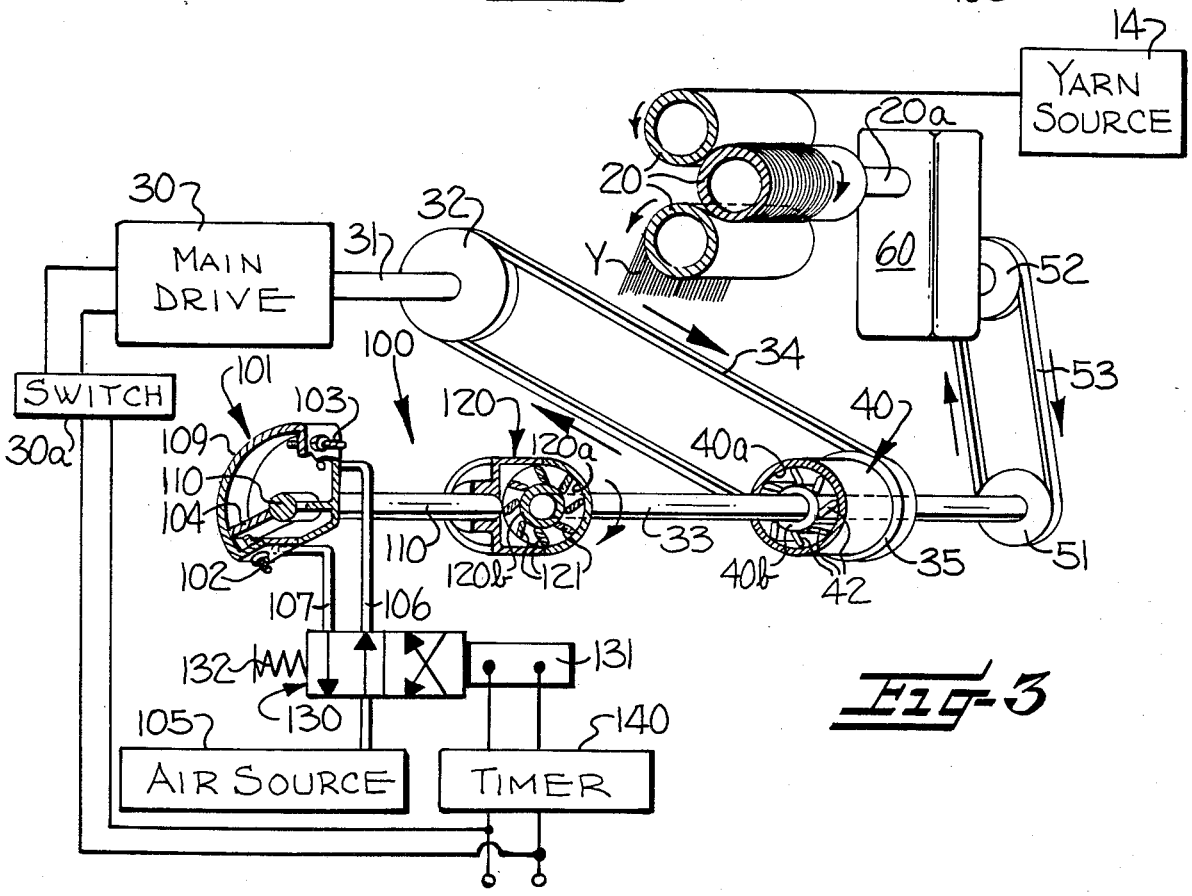
Fig-3

APPARATUS AND METHOD FOR ELIMINATING STOP MARKS IN CARPETS ON TUFTING MACHINES

BACKGROUND OF THE INVENTION

The present invention relates to novel apparatus and method for operating a tufting machine so as to avoid the production of stop marks in the pile fabric during such time that the tufting machine is not normally operating.

As is well-known in the carpet industry, a defect which often occurs during the production of tufted carpet when tufting machines are stopped or restarted is known as a stop mark or tufting streak. These stop marks are defects which are readily visible and appear on the face of the pile of the tufted carpet and generally extend across the full width thereof. This stop mark typically results when the row or rows of tuft loops closest to the needles, i.e., the last formed row of tufts, has the yarn pulled therefrom so that the height of the yarn forming the piles is less than it should be.

Various approaches are disclosed in the prior art in attempting to overcome this problem of stop marks. Beasley U.S. Pat. Nos. 2,840,019 and 2,857,867 address the problem of elimination of stop marks by providing an overfeed mechanism for the backing fabric that is fed to the tufting needles. Essentially, a locking type of drive train is disclosed so as to prevent any reverse movement of the backing fabric through the machine upon a start-up after the tufting machine had once been stopped.

Jackson U.S. Pat. No. 3,529,560 addresses the problem of stop marks by having the loopers clear the pile loops during such stoppage. This patent discloses stopping of the needle bar in an up position with the machine loopers clear of the the immediately formed pile loops so as to relieve yarn tension and eliminate stop marks.

Colbert U.S. Pat. No. 3,548,766 discloses an auxiliary drive that comes into operation upon stoppage of the tufting machine for the purpose of causing a pair of puller rolls to continuously rotate and slippingly engage the tufting yarns without feeding the yarns so as to maintain the yarns under tension rearwardly thereof and prevent the retraction of the yarns forwardly beyond the puller rolls. Stated somewhat differently, the puller rolls of Colbert serve for preventing an increase or buildup in the tension in the tufting yarns from causing a robbing action of the last formed row of tufts.

Cobble U.S. Pat. No. 3,762,346 discloses a device for relaxing the tufting yarns when the tufting machine is stopped so as to reduce the tension in the yarns that would otherwise cause the yarns to reduce the height of the last formed row of tufts.

Long et al U.S. Pat. No. 4,151,805 discloses a soft start-up mechanism for a tufting machine so as to avoid creation of stop marks as by the jerking of the pile yarns during start-ups wherein no soft start-up is employed. This patent also discloses an actuation of the yarn feed system ahead of restarting the main drive motor for the tufting machine.

With the foregoing prior art approaches in mind, it will be understood that the problem of stop marks is a long existing problem and one to which no universal solution has apparently been found. Applicant's analysis of the problem has led to a very simple solution which it is believed may be more universally applied to most any type of tufting machine for elimination of the problem of stop marks in the tufted fabric.

Briefly stated, this invention recognizes that the high tension present in the tufting yarns being fed to the tufting needles is essentially the cause of robbing of pile loops and creation of stop marks in fabric. It has been determined that upon stoppage of the tufting machine, if in response to such stoppage a small amount of tufting yarn, i.e., a relatively small incremental length of tufting yarn, is immediately fed forwardly from the feed rolls, that the tension in the yarn between the feed rolls and the last formed row of pile tufts will be so relieved as to avoid any robbing action of the last row of pile tufts. It has further been found that if the tufting machine is stopped for a prolonged period of time, that additional incremental amounts of tufting yarn may be fed to avoid build up of tension in the yarn from the feed rolls to the last row of pile tufts. Thus, in the simplest form, this invention solves the problem of formation of stop marks by the positive feed of an incremental length of the tufting yarns forwardly upon stoppage of the tufting machine. This is accomplished by an auxiliary drive means connected to the yarn feed rolls for feeding the tufting yarns forwardly a predetermined amount in response to stoppage of the main drive shaft.

Some of the objects and advantages of the invention having been stated, others will appear as the description proceeds, when taken in connection with the accompanying drawings in which FIG. 1 is a partially schematic fragmentary view of a tufting machine embodying the features of the present invention;

FIG. 2 is a schematic perspective view of the auxiliary drive means for advancing the feed of the tufting yarns upon stoppage of the machine; and FIG. 3 is another schematic, fragmentary view of a tufting machine main drive to the feed rolls with auxiliary drive means shown cooperating therewith.

Referring now more specifically to the drawings, a tufting machine embodying the features of the present invention is indicated generally at 10 in FIG. 1. As illustrated the tufting machine is provided with rows of tufting needles 11, and loopers 12 positioned below such tufting needles to engage loops of tufting yarn Y presented thereto. For feeding a backing fabric B to the needles 11, a pair of cooperating feed rolls 13 are provided.

To feed the tufting yarns Y from a suitable yarn source 14, such as a reel of beams of tufting yarns, not shown, a cluster of three feed rolls 20 are provided which feed rolls as illustrated in FIGS. 1 and 3 are so arranged relative to each other as to provide a pair of nips for positive engagement of the tufting yarns passing therethrough and being fed therefrom.

For driving the tufting machine during normal operation thereof, main drive 30 is provided which is controlled by a switch 30*a*. A main drive shaft 31 operably extends from the main drive and serves for imparting rotation to a pulley 32 affixed to the main drive shaft. Pulley 32 in turn serves for imparting rotation to an auxiliary drive shaft 33 through a belt 34 cooperating with another pulley 35. The pulley 35 is suitably mounted on the outer race 40*a* of a first slip clutch 40, of conventional construction, which slip clutch has an inner race 40*b* fixedly secured to the shaft 33. Sprags 42 positioned between the inner and outer races serve for imparting rotative movement of the outer race 40*a* to the inner race 40b when rotating in the direction as indicated by the arrows on the belt 34 in FIG. 3. To complete the drive to the feed rolls 20, another pulley 51 is secured to the auxiliary drive shaft 33, which pulley is in turn drivingly connected to another pulley 52 through a belt 53, to in turn impart rotation to a medial feed roll shaft 20a as through a reducer gearing assembly 60.

Upon stoppage of the tufting machine, an auxiliary drive broadly indicated by reference 100, is actuated for imparting a small incremental rotation to auxiliary drive shaft 33 for in turn rotating the feed rolls 20 to feed forwardly an incremental amount of tufting yarns Y of the order of about one-quarter of an inch, for example. This auxiliary drive for the feed rolls 20 takes the form of an air actuator 101, which as illustrated schematically in FIG. 3, is provided with adjustable stops 102 and 103 for controlling the stroke of movement of an internal actuator blade 104. As illustrated, a suitable air source 105 is provided which is connected through piping 106 and 107 to opposite sides of the air actuator blade 104 positioned for movement within an air actuator housing 109. The air actuator blade 104 is fixedly secured to an actuator drive shaft 110 so as to impart movement to an outer race 120a of a second slip clutch 120 mounted thereon. The clutch 120 in turn has an inner race 120b mounted on auxiliary drive shaft 33 and serving to connect the outer race 120a to the auxiliary drive shaft 33 through a series of interconnecting sprags 121.

Thus, upon movement of the actuator vane 104 in the direction of the arrow in FIG. 3, the outer race 120a of the second slip clutch 120 will cause driving interconnection with the inner race 120b through the sprags 121 interconnecting the same. It will of course be understood that upon the actuator vane 104 being returned to its initial starting positon as by the air now being directed through pipe 106 instead of 107, that the second slip clutch 120 will not cause any movement to auxiliary drive shaft 33 but will merely serve for positioning the air actuator vane for the next incremental overfeed action to be imparted to the feed rolls 20 as by a timer 140 set for actuation upon expiration of a predetermined duration of time following the initial feed of the tufting yarns. For effecting the redirection of the air from the source 105 to opposite sides of the air actuator vane 104, through pipes 106 and 107, a conventional four-way solenoid valve apparatus 130 is provided, schematically shown in FIG. 3. In this type of valve a solenoid 131 serves for slideably moving the valve in one direction against a compression spring 132, which serves for returning the valve to its original location.

It will thus been seen that the added apparatus to the tufting machine for effecting this positive overfeed of the tufting yarns in response to stoppage of the machine takes the form of very little additional mechanism, and that a timer may be provided for obtaining additional overfeeds of the tufting yarns during a prolonged duration of stoppage of the tufting machine.

It will be understood to those versed in the art that actuation of the solenoid air valve 130 may readily be triggered by the switch 30a upon stoppage of the main drive 30 for the tufting machine.

In the drawings and specification, there has been set forth a preferred embodiment of this invention, and although specific terms are employed, they are used in a generic and descriptive sense only and not for purposes of limitation, the scope of the invention being defined in the claims.

That which is claimed is:

1. In a tufting machine having tufting needles and loopers cooperating with said needles to engage loops of tufting yarn presented thereto, means for feeding a backing fabric to the tufting needles for the formation of tufts therein, and yarn feed rolls for positively feeding the tufting yarns from a source forwardly toward the tufting needles, and means including a main drive shaft for coordinated driving of said needles, loopers, feeding means for said backing fabric, and yarn feed rolls so as to form successive rows of pile tufts in the backing fabric, the combination therewith of means for preventing the formation of stop marks in the tufted fabric, as exhibited by a row of tufts of shorter height being formed when the tufting machine is stopped, said last recited means comprising auxiliary drive means connected to said yarn feed rolls for feeding the tufting yarns forwardly a predetermined amount in response to stoppage of the main drive shaft.

2. In a tufting machine according to claim 1, wherein said auxiliary drive means comprises an auxiliary shaft operatively interposed between said main drive shaft and said yarn feed rolls, first and second slip clutches operatively associated with said auxiliary shaft, means connecting said main drive shaft to said first clutch for in turn imparting rotation to said auxiliary shaft during normal operation of the tufting machine to rotate said feed rolls and feed the tufting yarns forwardly, said second clutch being so arranged to said auxiliary shaft as to slippingly engage the auxiliary shaft when said first clutch is in driving engagement, and auxiliary power means including an actuator shaft in alignment with said auxiliary shaft for operatively connecting said second clutch to said auxiliary shaft for in turn drivingly engaging said auxiliary shaft to impart movement to said feed rolls to feed the tufting yarns forwardly a predetermined amount upon stoppage of the main drive shaft, said first clutch slippingly engaging said auxiliary shaft when said second clutch is positively operating.

3. A tufting machine according to claim 2, wherein said auxiliary power means includes an air actuator having an air actuator vane, and means for adjusting the stroke of movement of said air actuator to vary the amount of movement of said auxiliary shaft, and to in turn vary the amount of feed of the tufting yarns.

4. In a tufting machine according to claim 1, wherein said auxiliary drive means comprises an auxiliary shaft operatively interposed between said main drive shaft and said yarn feed rolls, first and second slip clutches each having an inner race and an outer race, said inner races of said clutches being fixedly mounted on said auxiliary shaft, means connecting said main drive shaft to said outer race of said first clutch for in turn imparting rotation to said inner race and said auxiliary shaft during normal operation of the tufting machine, auxiliary power means including an actuator shaft in alignment with said auxiliary shaft, said outer race of said second clutch being fixedly mounted on said actuator shaft and drivingly engaging said inner race of said second clutch mounted on said auxiliary shaft to impart rotation to said auxiliary shaft upon stoppage of said main drive shaft.

5. A tufting machine according to claim 4, wherein said auxiliary power means includes an air actuator having an air actuator vane, and means for adjusting the stroke of movement of said air actuator to vary the amount of movement of said auxiliary shaft, and to in turn vary the amount of feed of the tufting yarns.

6. In a tufting machine having tufting needles and loopers cooperating with said needles to engage loops of tufting yarn presented thereto, means for feeding a backing fabric to the tufting needles for the formation of tufts therein, and yarn feed rolls for positively feeding the tufting yarns from a source forwardly toward the tufting needles, and means including a main drive shaft for coordinated driving of said needles, loopers, feeding means for said backing fabric, and yarn feed rolls so as to form successive rows of pile tufts in the backing fabric, the combination therewith of means for preventing the formation of stop marks in the tufted fabric, as exhibited by a row of tufts of shorter height being formed when the tufting machine is stopped, said last recited means comprising auxiliary drive means connected to said yarn feed rolls for feeding the tufting yarns forwardly a predetermined amount in response to stoppage of the main drive shaft, and means including a timer operably connected to said auxiliary drive means for again actuating the auxiliary drive to feed an additional amount of tufting yarns forwardly in the event the tufting machine is still stopped and has not been started.

7. A method of operating a tufting machine to prevent the formation of stop marks in the tufted fabric being made, comprising feeding a backing fabric to tufting needles while forming successive rows of tufts therein, and immediately following the stoppage of tufting machine positively feeding an incremental length of all of the tufting yarns forwardly toward the tufting needles to thereby prevent the formation of stop marks in the tufted fabric being made.

8. A method according to claim 7 including feeding an additional length of all of the tufting yarns after the elaspe of a predetermined period of time in the event the tufting machine is still stopped and has not been started.

9. A method of operating a tufting machine to prevent the formation of stop marks in the tufted fabric being made, the tufting machine being of the type having positive feed rolls for advancing the tufting yarns forwardly to the tufting needles, said method comprising feeding a backing fabric to tufting needles while forming successive rows of tufts therein, and immediately following stoppage of tufting machine imparting movement to the feed rolls to positively feed an incremental length of all of the tufting yarns forwardly toward the tufting needles to thereby prevent the formation of stops marks in the tufted fabric and in response to the stoppage of the tufting machine.

10. A method according to claim 9 including feeding an additional length of all of the tufting yarns in response to the elapse of a predetermined period of time of the tufting machine still being stopped and not having been started.

* * * * *